US006799330B1

(12) United States Patent
Lansdell

(10) Patent No.: US 6,799,330 B1
(45) Date of Patent: Oct. 5, 2004

(54) INFANT BIB

(76) Inventor: Julia B. Lansdell, 6154 Jumping Gully, Valdosta, GA (US) 31601

( * ) Notice: Subject to any disclaimer, the term of this patent is extended or adjusted under 35 U.S.C. 154(b) by 0 days.

(21) Appl. No.: 10/426,073

(22) Filed: Apr. 29, 2003

(51) Int. Cl.[7] ..... A41B 13/10
(52) U.S. Cl. ..... 2/49.4
(58) Field of Search ..... 2/49.1, 49.2, 49.3, 2/49.4, 49.5, 48, 50, 51, 46, 52, 75, 102, 104, 115, 122, 118, 119, 120

(56) References Cited

U.S. PATENT DOCUMENTS

| | | | | | |
|---|---|---|---|---|---|
| 439,736 | A | * | 11/1890 | Webber | 2/49.5 |
| 540,756 | A | * | 6/1895 | Odell | 2/49.2 |
| 593,618 | A | * | 11/1897 | Stackhouse | 2/49.5 |
| 797,434 | A | * | 8/1905 | Homeyer | 2/49.4 |
| 860,257 | A | * | 7/1907 | Slater | 2/49.2 |
| 889,073 | A | * | 5/1908 | Walbridge | 2/49.1 |
| 1,391,121 | A | * | 9/1921 | Keppel | 2/49.5 |
| 2,244,656 | A | * | 6/1941 | Asch | 2/49.2 |
| 2,635,243 | A | * | 4/1953 | Eskey | 2/49.2 |
| 2,694,199 | A | * | 11/1954 | Sanders | 2/49.2 |
| 3,286,279 | A | * | 11/1966 | Brown | 2/49.2 |
| 4,445,231 | A | | 5/1984 | Noel | |
| 5,075,897 | A | * | 12/1991 | Daniels | 2/48 |
| 5,432,952 | A | | 7/1995 | Tate | |
| 5,490,289 | A | | 2/1996 | Lehrer | |
| 5,661,851 | A | * | 9/1997 | Sanchez | 2/49.4 |
| 5,802,610 | A | * | 9/1998 | Burr | 2/49.4 |
| 5,911,311 | A | | 6/1999 | Hutchins | |
| 5,960,471 | A | | 10/1999 | Burton | |
| 6,237,150 | B1 | | 5/2001 | Lucas | |
| 6,308,333 | B1 | * | 10/2001 | Jackson | 2/49.4 |
| 6,499,140 | B1 | | 12/2002 | Benjamin et al. | |
| 2001/0047532 | A1 | | 12/2001 | Marrero | |

OTHER PUBLICATIONS

WAL–MART, Baby Bib–Baby SimplyBasic®, "SB Snap Bib," May 12, 2003, 1000 N. St. Augustine Road, Valdosta, Georgia.

* cited by examiner

*Primary Examiner*—A. Vanatta
(74) *Attorney, Agent, or Firm*—Langdale & Vallotton LLP; John P. Sinnott

(57) ABSTRACT

The bib has a neck portion with a neck hole that is large enough to fit comfortably around the wearer's neck. The neck hole has an opening that can either be pulled over the wearer's head by means of an elastic material, or divided into an exposed strip of fabric and a coextensive underlaying strip of fabric. These strips of fabric are releasably fastened together. An expanse of protective material extending from the transverse end of the neck portion prevents food and drink from staining or soiling the wearer's clothing during the course of hand feeding. Beneath the expanse of protective material is a first layer of absorbent material. This first layer overlays a lower, second layer of absorbent material. The first and second absorbent layers offer a face wipe to the user for removing food from the wearer's face. Because of the very open nature of the expanse of protective material and the underlaying first and second layers of absorbent material, ordinary agitation in a home washing machine will separate the first and second layers of absorbent material from each other to allow washing liquid to flow over and around the entire bib, thereby thoroughly cleaning the bib.

9 Claims, 3 Drawing Sheets

INFANT BIB

CROSS-REFERENCES TO RELATED APPLICATIONS

None

STATEMENT REGARDING FEDERALLY SPONSORED RESEARCH OR DEVELOPMENT

None

REFERENCE TO "SEQUENCE LISTING"

None

BACKGROUND OF THE INVENTION

This invention relates to protective garments and, more particularly, to a bib having a stain-resistant protective surface and with an integral face wipe of absorbent material that is lodged under the protective surface, and the like.

The requirement for an older person to hand feed an infant between the time that the infant begins to ingest solid food and the time that the child is able to feed itself always is subject to a number of difficulties. Thus, apart from the infant's acceptance or rejection of the food that is being hand fed, there is a need to protect the infant's garments from food stains and soiling and, from time-to-time during feeding, to wipe food from the infant's hands, face and other parts of the child's body.

To protect an infant's clothing from food stains during feeding, it has been customary to place a bib about the infant's neck. The bib has one portion that fits around and is secured to the child's neck and an expanse of protective material extending from the neck portion that rests on the infant's chest. This protective material, which can be made of a stain-resistant plastic, a disposable paper, an absorbent cloth or the like, intercepts falling food and drink in order to prevent that food and drink from soiling or staining the child's underlaying garment.

There is a further need as a part of the hand feeding process, for an absorbent wiping material that will remove the food that invariably adheres to the areas around the hands, mouth, ears, hair and other bodily parts of the child being fed. Ordinarily, the person doing the hand feeding will use a towel or face cloth that is separate from the bib to clean the child's hands and face from time-to-time during feeding. But this often is awkward, requiring the older person to leave the child unattended in a high chair while obtaining a fresh towel or face cloth.

Suggestions, however, have been advanced to combine a bib and an absorbent wiping material into a single item of protective clothing. One proposal of this nature provides a bib with a panel that extends from the neck portion over the child's chest. This panel terminates at its lower end in an upturned portion, secured on its two sides to the adjoining edges of the panel to form a pocket between the upturned portion and the adjacent part of the panel. The upturned portion of the bib, moreover, has an apron, not joined to the panel, that bends over and outward from the upturned portion.

The weight of the apron not only draws open the pocket between the adjacent part of the panel and the upturned portion, but also provides an attached absorbent wiping material for the infant wearing the bib.

There are a number of disadvantages associated with this proposed construction. For example, food particles fall into the pocket and lodge there, making a thorough laundering of the bib difficult, if not impossible. The absorbent wiping material, moreover, is in an exposed position, likely to become spattered with food and thus not entirely satisfactory for the purpose of wiping the infant's hands and face.

Thus, there is a need for a readily launderable bib and wiping material that protects an infant's underlaying clothing from soiling and food stains while providing an essentially fresh absorbent wiping material for the child.

BRIEF SUMMARY OF THE INVENTION

These, and other unsatisfactory features that characterize various bib structures are overcome to a large extent through the practice of the invention. For example, an illustrative embodiment of the invention provides a neck portion for temporarily attaching the bib to the infant's neck. Joined to the neck portion is an expanse of protective material that extends across the infant's chest and has an exposed surface to intercept spilled food and drink.

In accordance with a feature of the invention, however, a layer of absorbent material, generally coterminous with at least a portion of the unexposed surface of the expanse of material that is oriented toward the infant's chest, bears against another, second layer of absorbent material, the second layer can be borne on the garment that covers the infant's chest. With respect to the illustrative embodiment of the invention under consideration, these absorbent material layers can be formed from a single, folded over portion of a suitably absorbent material.

When used, the bib is placed on the infant by fastening the neck portion about the neck of the child who is to be fed. The expanse of material that extends across the infant's chest prevents falling food and drink from soiling or staining the infant's underlaying garment.

To clean the child's hands, face and other bodily surfaces, however, and in accordance with another feature of the invention, it is only necessary to lift at least a portion of the expanse of protective material to expose the fresh, absorbent material sandwiched between the protective material and the layer of absorbent material closest to the garment that covers the child's chest. Either of the two layers of the absorbent material so exposed can be grasped and applied to the infant's mouth, face or other body surfaces to wipe away adhering food, and the like.

On release of the face wipe material, the expanse of protective material falls back into place on the child's chest, covering the now soiled absorbent material. This soiled layer of absorbent material is thus sandwiched between the expanse of protective material and the second layer of absorbent material that is borne on the infant's chest, thereby preventing the food adhering to one or both of the layers of absorbent material from spreading to the infant's clothing and to other surfaces.

Cleaning a bib, made in accordance with the present invention, is efficient and thorough because there are no pockets in the bib to block the through flow of wash water during laundering because all surfaces of a bib that characterizes the invention are exposed and fully immersible in the wash water.

Further in this regard, a bib that embodies characteristic features of the invention can be made of any suitable material, e.g. plastic, terry cloth, and the like, or even formed as a disposable paper item.

Nor are the principles of the invention limited to children's bibs, but these principles also are applicable to adult bibs for use by the handicapped, and the like.

These and other features of the invention are described in more complete detail in the following description of a preferred embodiment of the invention, when taken with the figures of the drawing. The scope of the invention, however, is limited only by the claims appended hereto.

DETAILED DESCRIPTION OF INVENTION

Figure 1:
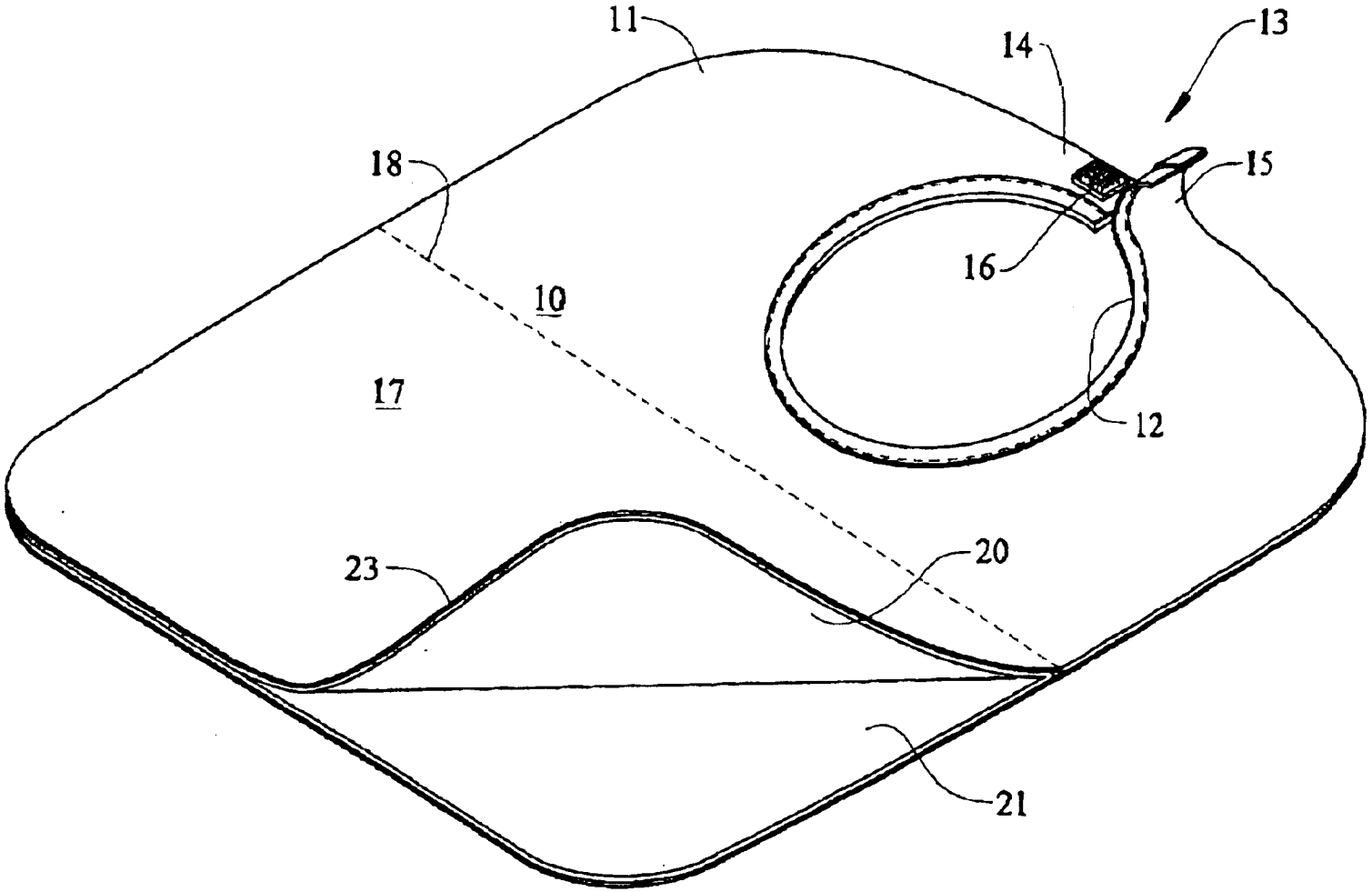
FIG. 1 is a plan view of a bib embodying features of the invention in which a portion of the exposed protective surface of the bib has been folded over to show underlaying absorbent material.

For a more complete appreciation of the invention, attention is invited to FIG. 1, which shows a protective garment, or an infant's bib 10 that has a neck portion 11. Also shown is a generally circular neck hole 12, formed either of a material that is sufficiently elastic to fit over an infant's head and rest comfortably about the neck of an infant that is between the age that the child begins to ingest solid food and the age at which the child is able to feed itself, or having an opening in the neck portion that can be opened and closed to place and then to fasten the bib 10 about the child's neck.

Figure 3:
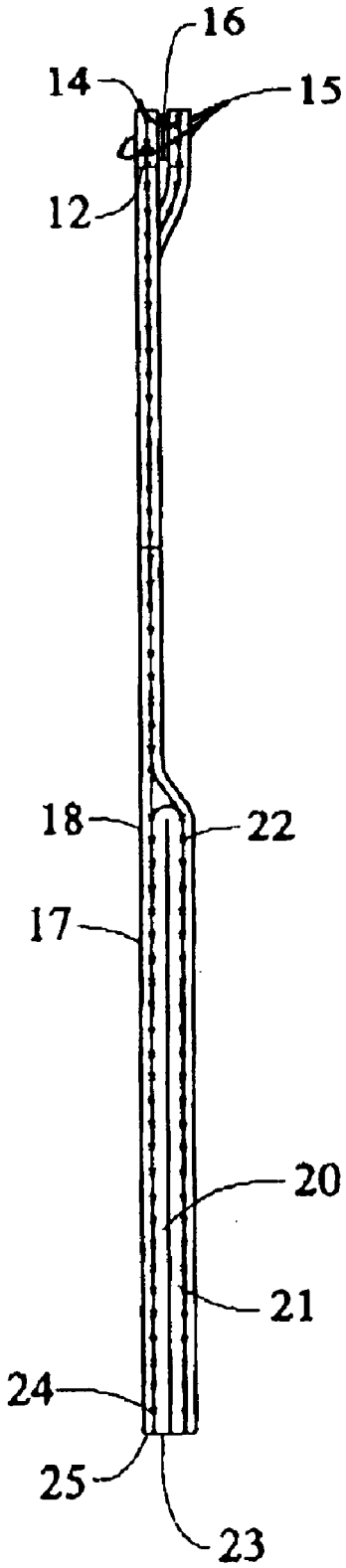
FIG. 3 is a side elevation of the bib shown in FIGS. 1 and 2, with the exposed protective material in place to catch food particles.

As shown in FIG. 1, the neck portion 11 has an apex 13 located in the approximate position of the back of the neck of the wearer (not shown in the drawing). The apex 13 is divided into a strip 14 of fabric and a coextensive strip of fabric 15 (FIG. 3). Fastening means 16, of which VELCRO strips, a surface of tiny hooks and a complimentary surface of clinging pile that can be pressed together and pulled apart, as shown, or other suitable means of which snap fasteners or a pair of ribbons for tying are illustrative, releasably join together the fabric strips 14, 15.

An expanse of exposed protective material 17 (FIG. 1) is provided at transverse end 18 of the neck portion 11. The protective material 17 may be of any suitable substance, of which a washable cloth, a flexible plastic or the like, are typical.

Beneath the expanse of the protective material 17, and preferably coterminous with the material 17 is a first layer of absorbent material 20, a portion of which has been turned over and exposed in FIG. 1. Terry cloth, for instance, is quite suitable for the purposes of the first layer of absorbent material 20. The first layer of absorbent material 20, moreover, overlays a lower, second layer of absorbent material 21 which is also made of a suitable absorbent substance.

In this illustrative embodiment of the invention, the lower, second layer of absorbent material 21 also is generally coterminous with the expanse of protective material 17.

Thus, as shown in the drawing, the first absorbent layer 20 is essentially sandwiched between the unexposed side of the expanse of protective material 17 and the lower, second layer of absorbent material 21.

Figure 2:
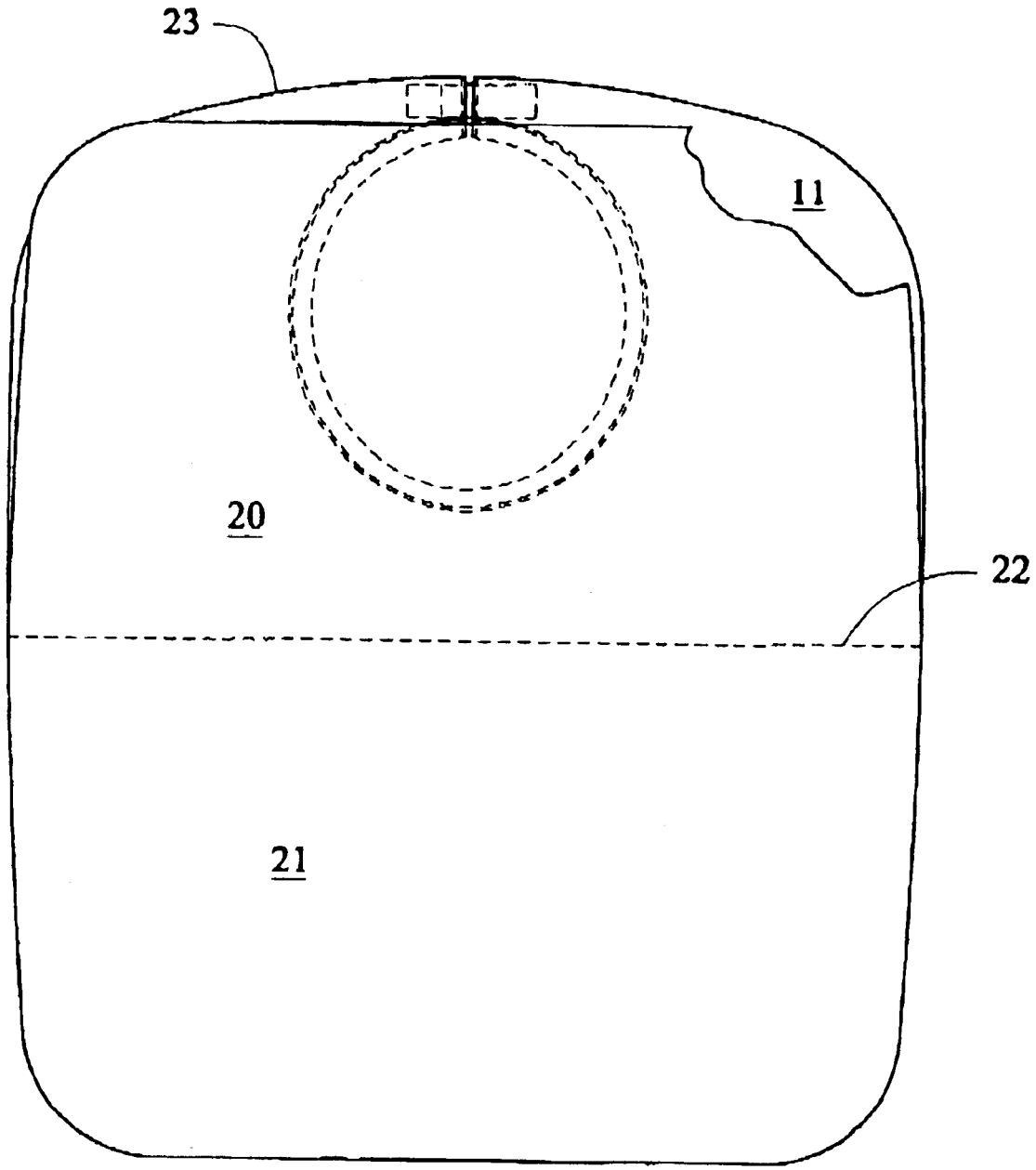
FIG. 2 is a plan view of the bib shown in FIG. 1 with the exposed protective surface folded back to display both layers of the absorbent material.

Turning now to FIG. 2, it can be seen that the first layer of absorbent material 20 is folded back over the neck portion 11 in order to fully expose both the first and second layers of absorbent materials 20, 21. As illustrated in FIGS. 2 and 3, the first and second layers of absorbent material 20, 21 are formed from a single sheet of material, joined by stitching 22, or other appropriate means, to the expanse of the protective material 17 in the vicinity of the transverse end of the neck portion 18 (FIGS. 1 and 3).

As best illustrated in FIG. 3, an end 23 of the first layer of absorbent material 20 also is joined by stitching 24 or the like to end 25 of the expanse of protective material 17 that is opposite to the neck portion transverse end 18.

In operation, and as shown in FIG. 1, the fastening means 16 in the neck portion is released to enable the exposed fabric strip 14 and the fabric strip 15 to be separated. The neck portion 11 of the bib 10 is placed with the neck hole 12 about the infant's neck (not shown in the drawing). The fabric strips 14 and 15 then are placed in mutual contact and the fastening means 16 is closed to secure the bib 10 to the child's neck.

The weight of the expanse of protective material 17, under gravitational or other force, falls across the infant's chest (not shown in the drawing) to prevent the child's garments (also not shown in the drawing) beneath the bib 10 from being soiled or stained during hand feeding.

While feeding the infant, and as best shown in FIG. 1, it will become desirable from time-to-time, to wipe food from the vicinity of the infant's mouth, face, hair or other parts of the child's body. To provide an adequate absorbent wiping material in accordance with a salient feature of the invention, an older person (not shown in the drawing) grasps a portion of the expanse of protective material 17 and the attached first layer of absorbent material 20 and turns the portion over to expose at least not only some of the first layer of absorbent material 20, but also the underlaying second layer of absorbent material 21. Should the cleaning circumstances require, the person grasping the protective material 17 and the first absorbent layer 20 can lift the entire expanse of protective material 17 to expose both the first and the second layers of absorbent material 20, 21 as illustrated in FIG. 2.

The first and second absorbent layers 20, 21 fully exposed in the foregoing manner and as shown in FIG. 2 offer to the user the option of using either the first layer of absorbent material 20 or the second layer of absorbent material 21, whichever one of these two layers is more convenient, for removing the food from the child's body.

After the child's meal is complete, the fastening means 16 is released to enable the bib 10 to be taken from the infant and laundered. Because of the very open nature of the expanse of protective material 17 and the underlaying first and second layers of absorbent material 20, 21, ordinary agitation in a washing machine (not shown in drawing) will separate the first and second layers of absorbent material 20, 21 from each other to allow washing liquid to flow over and around the entire bib, thereby thoroughly cleaning the bib.

Consequently, there is provided accordance with the invention an improved bib for use by infants and adults alike that overcomes many of the unsatisfactory characteristics of earlier bib structure proposals.

What is claimed is:

1. A bib for cleaning and for protecting clothing comprising:

a neck portion having a neck hole, a transverse end to said neck portion, an expanse of protective material extending from said transverse end of said neck portion, a first selectively exposed layer of absorbent material for the cleaning laying beneath and generally coterminous at least with said expanse of protective material, a second layer of absorbent material for the cleaning selectively exposed with said first absorbent layer also generally coterminous at least with said expanse of protective material and underlaying said first absorbent layer, means for attaching said first layer of absorbent material to the bib, and means for attaching said second layer of absorbent material to the bib.

2. A bib according to claim 1, wherein said neck portion further comprises an elastic material.

3. A bib according to claim 1, wherein said neck portion further comprises a division in said neck portion having opposing first and second strips of fabric, and a means for releasably fastening said opposing first and second strips of fabric.

4. A bib according to claim 3, wherein said means for releasably fastening said first and second fabric strips further comprises snap fasteners.

5. A bib according to claim 3, wherein said means for releasably fastening said first and second fabric strips further comprises a surface of hooks and a complementary surface of clinging pile.

6. A bib according to claim 3, wherein said means for releasably fastening said first and second fabric strips together further comprises a pair of ribbons.

7. A bib according to claim 1, wherein said first and second layers of absorbent material are attached to said expanse of protective material in the vicinity of said transverse end of said neck portion.

8. A bib according to claim 1, wherein said means for attaching said first and second layers of absorbent material to said protective material further comprises stitching.

9. A bib for protecting personal clothing during feeding from food stains comprising:

A neck portion having a neck hole, a transverse end to said neck portion, an expanse of exposed protective material extending from said transverse end of said neck portion, a first layer of absorbent material laving beneath and generally coterminous at least with said expanse of exposed protective material, a second layer of absorbent material also generally coterminous at least with said expanse of exposed protective material and underlying said first layer, means for attaching said first layer of absorbent material to the bib, and means for attaching said second layer of absorbent material to the bib, wherein said first and second layers of absorbent materials are formed by a single piece of material being folded essentially in half.

* * * * *